United States Patent [19]

Jones et al.

[11] Patent Number: 4,466,145

[45] Date of Patent: Aug. 21, 1984

[54] STRETCHER

[75] Inventors: David B. Jones, Rhondda, Wales; Brian D. Powell, Carlisle, England

[73] Assignee: MFC Survival Limited, Rhondda, Wales

[21] Appl. No.: 384,536

[22] Filed: Jun. 3, 1982

[30] Foreign Application Priority Data

Jun. 9, 1981 [JP] Japan ..... 56-17596

[51] Int. Cl.[3] ..... A61G 1/00

[52] U.S. Cl. ..... 5/82 R; 441/40

[58] Field of Search ..... 5/82 R, 449, 455; 441/40, 41, 42, 66, 129

[56] References Cited

U.S. PATENT DOCUMENTS

| | | | |
|---|---|---|---|
| Re. 28,916 | 7/1976 | Rice et al. | 5/82 R |
| 919,159 | 4/1909 | Goddard | 5/82 |
| 1,981,666 | 11/1934 | Ridley | 5/455 |
| 2,410,181 | 10/1946 | Peters | 5/82 |
| 3,287,895 | 11/1966 | Hire | 5/82 R |
| 3,425,071 | 2/1969 | Frieder et al. | 441/40 |
| 3,449,776 | 6/1969 | Brock | 5/82 R |
| 4,067,075 | 1/1978 | Leathers et al. | 5/82 R |
| 4,234,982 | 11/1980 | Bez et al. | 5/82 R |

FOREIGN PATENT DOCUMENTS

| | | | |
|---|---|---|---|
| 527508 | 11/1956 | Belgium | 441/40 |
| 682055 | 3/1964 | Canada | 5/460 |
| 1250638 | 12/1960 | France | 5/82 |
| 1535617 | 8/1968 | France | 5/82 R |
| 1536191 | 12/1978 | United Kingdom | 5/82 R |
| 563976 | 8/1977 | U.S.S.R. | 5/82 R |

*Primary Examiner*—Alexander Grosz
*Assistant Examiner*—Vinh Luong
*Attorney, Agent, or Firm*—Spensley, Horn, Jubas & Lubitz

[57] ABSTRACT

A compact and portable stretcher has a rigid body board long enough and wide enough to support a supine human body. It is overlaid with an inflatable mattress and may be flanked by inflatable buoyancy tubes.

The body board is preferably made up from a number of rigid portions each the full width of the board and hingedly joined together to fold up around the deflated flank tubes and mattresses to form a back-pack in which the inflatable components are protected in transport by the body board portions.

The body board is held flat by stiffener strings along the long edges of the body board. These comprise elements hingedly connected where the body board portions are joined, and movable between a relaxed disposition where they permit folding of the board and a standing disposition where they hold the board flat for use.

13 Claims, 7 Drawing Figures

STRETCHER

BACKGROUND OF THE INVENTION

This invention relates to a stretcher (being an appliance for carrying a disabled person) and, more particularly but not exclusively, is concerned with a portable stretcher useful to emergency and rescue services.

There have been a number of prior proposals for stretchers to be used by emergency and rescue services. Stretchers of the "carrying sheet" type are readily transportable but are limited in their ability to provide rigid support over the full width and length of a supine human body. Those previously proposed portable stretchers which would provide ample support are too large and heavy to be readily transportable over long distances by a single human bearer.

BRIEF SUMMARY OF THE INVENTION

The present invention seeks to provide a fully supportive stretcher which is, at the same time more readily transportable than the prior proposals.

According to a first aspect of the present invention there is provided a stretcher comprising means for providing a rigid surface large enough to provide support to a supine human body over substantially the entire width and length of the body, and an inflatable body cushioning means which is situated between the rigid surface and the supine human body in use of the stretcher.

The combination of a rigid surface and an inflatable cushion combines lightness and strength, and thereby facilitates transport of the stretcher, while empty, by a single human bearer.

The means for providing a rigid surface is preferably constituted by (i) a body board made up from at least three rigid body support board portions which extend in a transverse direction across the full width of the board and in a longitudinal direction along a portion of the length of the board; and (ii) means for limiting movement of the board portions relative to one another to movement between a compact, transport disposition of the stretcher and a flat, useful disposition of the stretcher.

The compactness of the transport disposition makes it possible to provide a stretcher light enough and small enough to be carried easily by one person, and this may be so even if no inflatable cushioning means is provided. Thus, according to a second aspect of the invention there is provided a stretcher characterised in that it comprises a body board made up from at least three rigid body support board portions which extend in a transverse direction across the full width of the body board and in a longitudinal direction along a portion of the length of the board, and means for limiting movement of the board portions relative to one another to movement between a compact transport disposition of the stretcher and a flat useful disposition of the stretcher.

The parts of the stretcher are preferably so shaped that, when the stretcher is in the transport disposition, the entire stretcher can be arranged as a back-pack, which is preferably such that no dimension exceeds one-third of the length of the stretcher when in use. Preferably the board portions are circumjacent the cushioning means, in the transport disposition, thereby affording some protection to the inflatable cushioning means in transport.

Preferably the support board portions are connected by hinge formations, which can be of fabric, so retaining the body support board as a single component which can be folded into a compact configuration. Thus, a pack having a width which is similar to that of the stretcher, a thickness X approximately one-tenth of the length of the stretcher and a length Y approximately one-quarter of the length of the stretcher can be provided with a body support board having a central portion of length (along the length of the stretcher) X to which is joined by hinges two adjacent board portions of length Y, and then two further portions of length no more than X. In particular, these two further portions can be of length X/2 and connected to two end portions of the body support board having a length no greater than Y. If the two ends of such a board are folded in to the middle of the board then a pack of the same width as the support board and with X and Y as its other two major dimensions, will be formed.

Conveniently the body support board portions are made from a composite material of fibres set in a resin matrix in order to provide the maximum available stiffness consistent with a light weight.

Stiffening means may be employed to limit relative movement of the board portions when the stretcher is in use. In one embodiment, not at present preferred, but described in British Patent Application No. 8117596, the priority of which is claimed herein, these stiffeners are of 25 mm square section aluminium alloy tube and are attached to the body support board so that they are not lost when the stretcher is dismantled. None of the stiffeners is longer than one-third of the length of the stretcher and, where it is convenient to connect together the stiffeners for use of the stretcher, this can be effected by the use of retractable inserts housed within the ends of the stiffener tubes.

It will usually be advantageous to provide buoyancy tubes along the flank edges of the body support board, so that the stretcher is capable of supporting an injured person on the surface of a body of water. Conveniently the lower surfaces of the buoyancy tubes are resistant to abrasion and are faired at one end at least of the stretcher so that the stretcher is more readily suitable to be handled as a sledge in use i.e. is adapted for sledging. Again, it will often be convenient to nip the buoyancy tubes in at the waist area to restrict the overall width of the stretcher (for example, to not more than one meter so that the stretcher can readily be passed through doorways) and to provide a convenient location point for the connection between the buoyancy tubes and the body support board.

Advantageously the upper surface of the body support board is provided with an inflatable mattress and has a sufficient number of straps or bindings to enable the necessary restraint to be applied to the injured person on the stretcher. It is useful to divide the mattress into a trunk cushion and a head cushion, and to provide means for establishing a degree of inflation of the head cushion different from that of the truck cushion. Usually a survival cover or sheet will be provided to extend over the body support board for covering the injured person and conveniently this is in two halves connected by a zip fastener running centrally along the length of the sheet or cover.

BRIEF DESCRIPTION OF THE DRAWINGS.

For a better understanding of the invention, and to show more clearly how the same may be carried into effect, reference will now be made, by way of example, to the accompanying drawings in which.

DETAILED DESCRIPTION OF THE PREFERRED EMBODIMENT.

Figure 1:
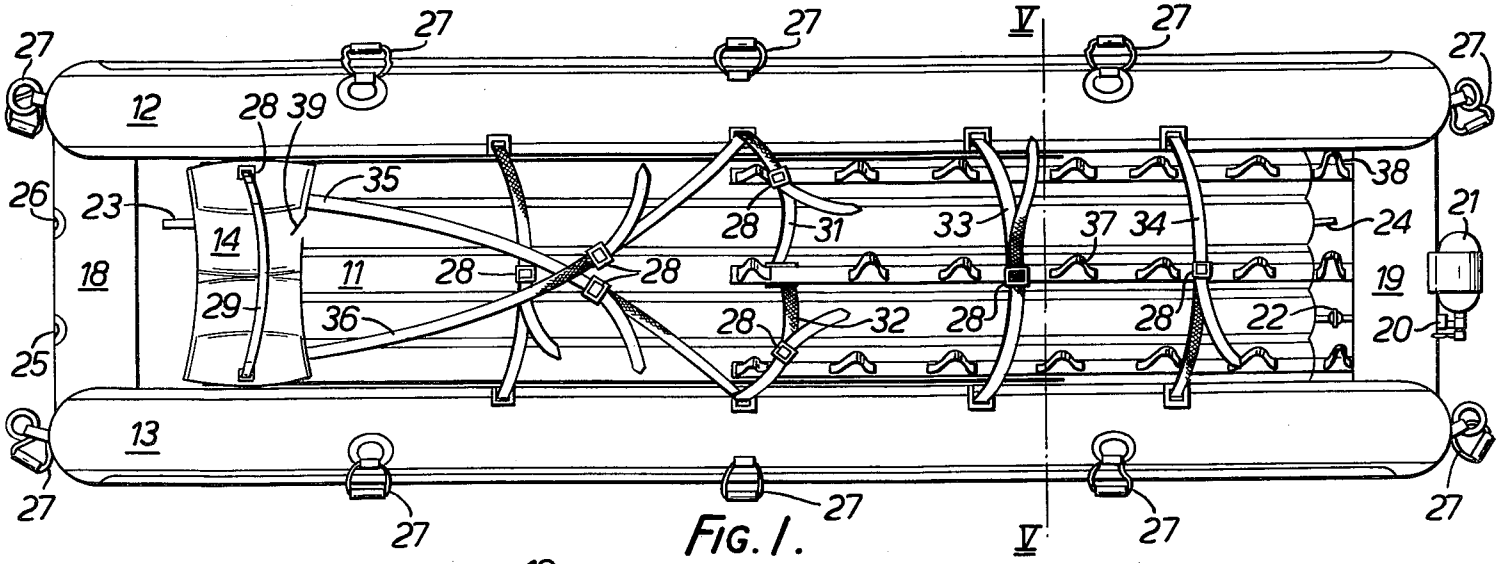
FIG. 1 is a plan view of one embodiment of a stretcher according to the invention, when inflated and in its flat disposition, but with a survival cover removed for reasons of clarity.
Figure 2:
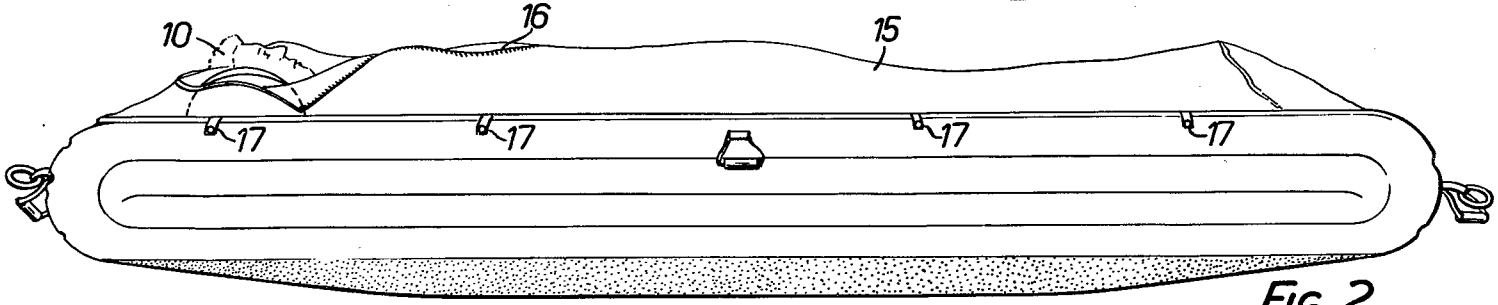
FIG. 2 is a side elevation of the stretcher of FIG. 1 but with the survival cover included.

Referring to FIGS. 1 and 2, the trunk and legs of the body of an injured person 10 is borne on an inflatable mattress 11 carried between two large buoyancy tubes 12 and 13. The head of the patient 10 rests upon a V-shaped headrest cushion 14, and his body is covered by a laminated survival cover 15 which incorporates leaves of the so-called "Space Blanket" material for resisting loss of heat from the patient 10. Also provided, but not shown, is a transparent visor for covering the head of the patient 10, when necessary. The survival cover 15 has a centrally placed zip fastener 16 running the entire length of the cover, and tags 17 which engage studs on the tubes 12 and 13 with a snap action.

FIG. 1 shows that the main buoyancy tubes 12 and 13 are connected by a front thwart support tube 18 and rear tube 19. This rear tube carries a main inflatable valve 20 through which supplies of compressed air or, if desired, compressed carbon dioxide gas, may be introduced into the inflatable cavities of the stretcher. A bottle 21 of sufficient compressed gas to inflate the stretcher may be secured to the rear tube.

The gas passes directly from the tube 19 into the main buoyancy tubes 12 and 13 and the front thwart support tube 18, but indirectly, through a mattress inflation cock 22, into the mattress 11 and the headrest 14. Between the mattress 11 and headrest 14 there is a non-return valve 39 shown in the drawing. The amount of air in the headrest is controllable by a deflation valve 23, and the amount of air in the mattress 11 by a mattress deflation valve 24. With this arrangement, it is possible to deflate the mattress 11 entirely, while all the other inflatable components of the stretcher remain fully inflated, and this may be useful for spinal patients or where some other form of mattress is to be used.

The front thwart support tube 18 carries a pressure relief valve 25 and a deflation plug 26. Around the periphery of the stretcher there are provided a number of lifting rings and handles 27.

FIG. 1 shows one possible arrangement of straps and harness bonded to the inflatable mattress 11, the main buoyancy tubes 12 and 13 and the body support board beneath the mattress 11 and described further hereinbelow, to provide the necessary restraint for an injured person lying on the stretcher. Conveniently, the various straps and harness incorporated quick release buckles 28. The straps may therefore comprise a head strap 29, a chest strap 30, groin straps 31 and 32 a knee strap 33 and an ankle strap 34, adjustable, diagonal body-securing harness straps 35 and 36, a plurality of leg-securing loops 37 and several traction loops 38.

As best seen in FIG. 2, the ends of the buoyancy tubes 12 and 13 are faired into a smoothly rounded shape to facilitate "sledging" i.e. dragging, the stretcher over the ground. The ground-contacting surfaces of the stretcher are protected against abrasion if such use is contemplated. The illustrated embodiment is adapted to be safely towed over a water surface, as the stretcher floats thereon.

Figure 3:
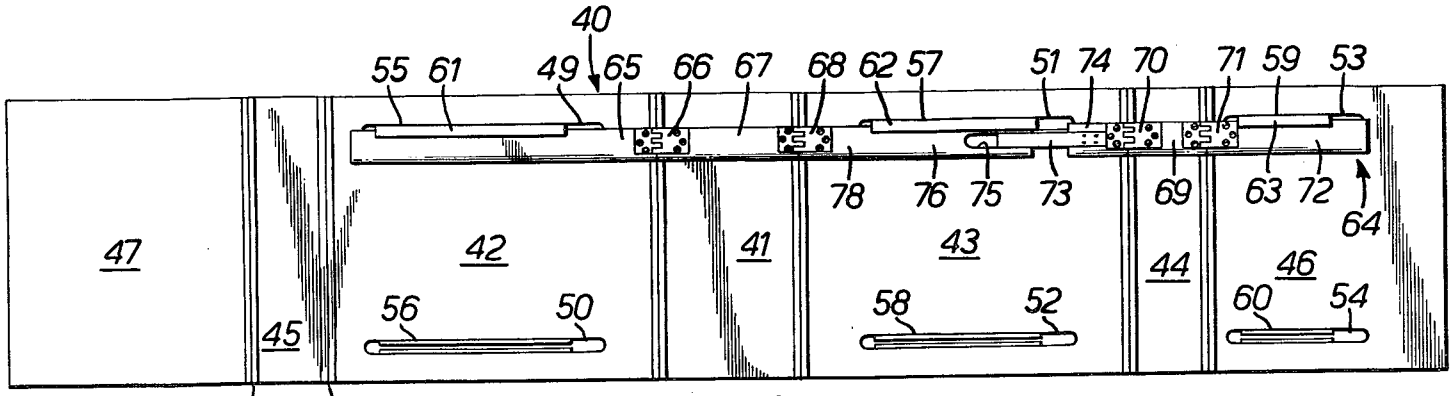
FIG. 3 is a plan view of the body board of the stretcher with one stiffener removed in order to show slots in the body board.

FIG. 3 shows that the body support board 40 is made up of a relatively short central board portion 41 flanked by two large portions 42 and 43, flanked in turn by two rather short portions 44 and 45 and then two equal sized end portions 46 and 47, the adjacent portions of the board being connected to one another by fabric hinges 48 and together providing a board having a length of nearly 2 m and a width of approximately 40 cms.

Figure 6:
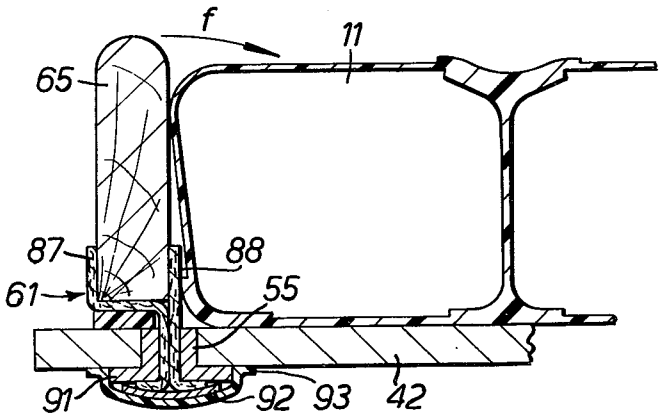
FIG. 6 is an enlarged detail of FIG. 5 showing the attachment of one stiffener element to an associated portion of the body board.

The portion 42 has a pair of slots 49 and 50, the portion 43 has a pair of slots 51 and 52 and the end portion 46 (which underlies the headrest 14) has a pair of slots 53 and 54. In each of the slots is slidably movable an aluminium slide member 55 to 60 respectively. Connected to the slide member 55 by a fabric hinge 61, the slide member 57 by a fabric hinge 62 and the slide member 59 by a fabric hinge 63 is a stiffener string generally referenced 64. The hinges allow the string to pivot through a right angle between a relaxed disposition flat on the board 40 as shown in FIG. 3 and a standing disposition perpendicular to the board 40 as shown in FIG. 6, referred to hereinbelow.

The string 64 comprises an end element 65 of marine grade plywood connected to the hinge 61 and by a strong brass hinge 66 to a first centre element 67 which overlies the centre board portion 41. This element 67 is connected by a similar brass hinge 78 to a compensating element 68 which overlies the board element 43. A short element 69 is connected by a brass hinge 70 to the compensating element 78 and by another brass hinge 71 to an end element 72 itself connected to the fabric hinge 63.

A string which is mounted to the slide members 56, 58 and 60 is similar to the string 64 and a mirror image of it. It is omitted from FIG. 3 the better to show the slide members 56, 58 and 60.

Figure 4:
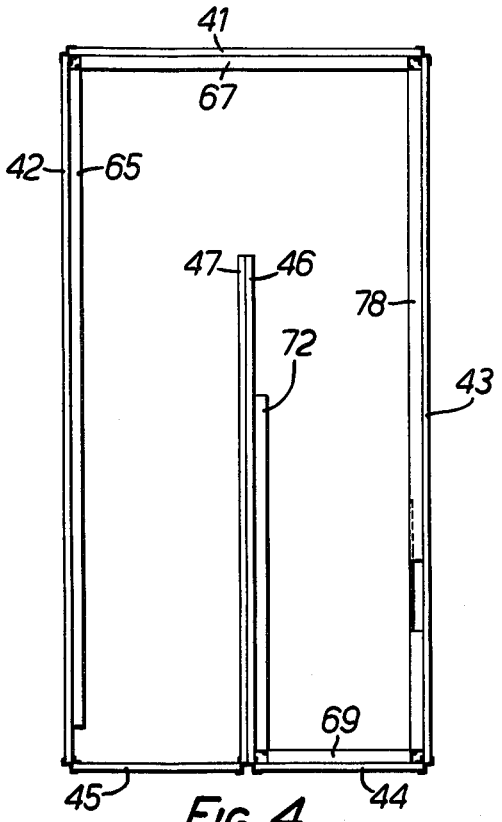
FIG. 4 is a side elevation of the stretcher when it is in its compact, transport disposition.

The way in which the strings function will become clearer from the description of FIG. 4 which follows. The length of the compensating element 78 is variable by a small extent, as is shown diagrammatically in FIG. 3 by a male member 73 of a first portion 74 of the compensating element which is slidable in a channel 75 in a second portion 76 of the element 78.

FIG. 4 shows the body board 40 and stiffener string 64 in the compact, transport disposition of the stretcher, and it is believed that inspection of the reference numbers will reveal the manner in which the board and string is folded. It will be appreciated that the brass hinges 66, 68, 70 and 71 each fold at the position of one of the fabric hinges 48 connecting adjacent body board portions, and that the compensating element 78 serves to secure sufficient variation in the distance separating the brass hinges 68 and 70 to allow the body board 40 to move between its folded, compact disposition and its flat disposition.

Figure 5:
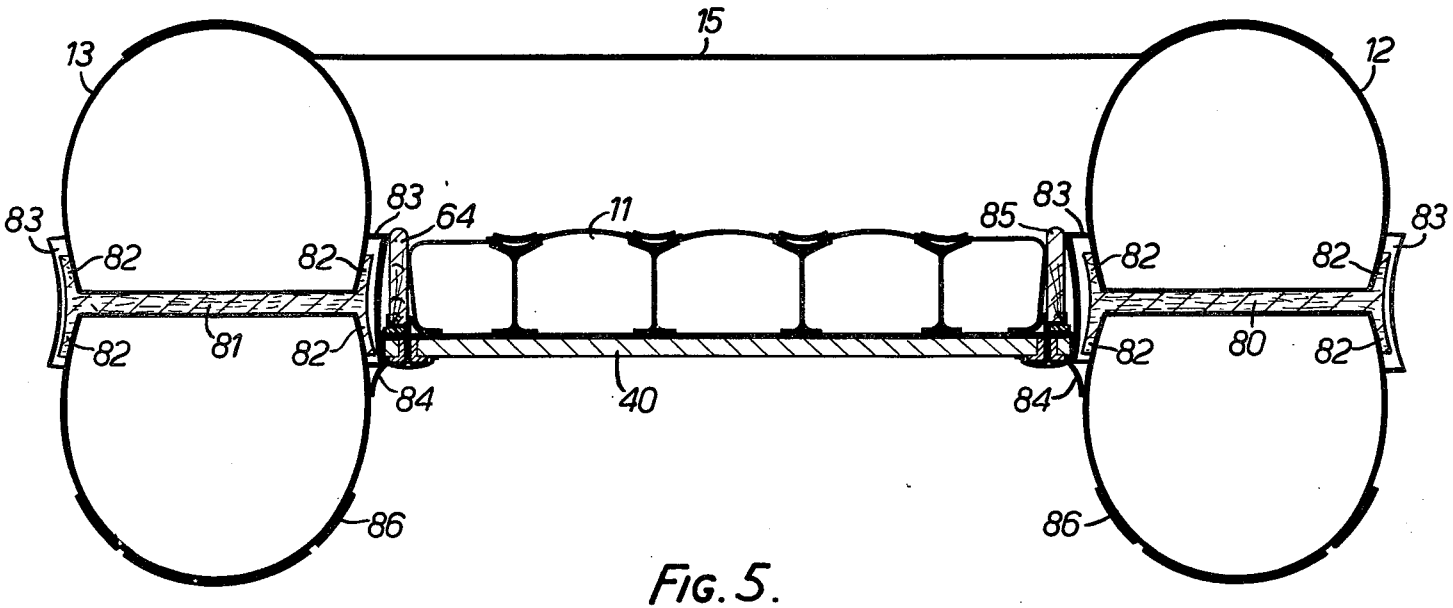
FIG. 5 is a diagrammatic cross-section of the stretcher, on the line V—V shown in FIG. 1.

Turning now to FIG. 5, it can be seen that the main buoyancy tubes 12 and 13 are nipped in at the waist thereof by H-section reeds 80 and 81 respectively. It is preferable that the end flanges 82 of the reeds are secured to the outer surface of the buoyancy tubes, and then further secured by fabric holding covers 83 as shown in the drawing. An alternative, but less preferred, arrangement would be to secure end flanges of the reeds 80 and 81 to the interior surface of the bouyancy tubes 12 and 13.

Strips 84 of material secure the buoyancy tubes 12 and 13 to the long edges of the body support board 40 of the stretcher. The board 40 is supported as described above by stiffener strings 64 and 85, and carries the inflatable mattress 11 of the stretcher on its upper surface. The construction of the mattress 11, as shown in FIG. 5, is conventional and need not be described further herein. Above the mattress 11 is shown the survival cover 15. FIG. 5 shows sheets of abrasion-resistant material 86 may be bonded to the lower surfaces of the buoyancy tubes 12 and 13 to resist damage to the gas-tight construction of the tubes 12 and 13 during sledging of the stretcher.

The detail view of FIG. 6 shows the stiffener element 65 secured to the slide member 55 by the fabric hinge 61 which comprises a wide strip 87 and a narrow strip 88 of fabric which together flank the lower longitudinal edge 89 of the element 65 and extend through a slot 90 defined by a slotted element 91 of the slide member 55. The lower edges of the strips 87 and 88 are secured between a downward-facing surface of the slotted element 91 and an upward-facing surface of a facing element 92 of the slide member 55.

The slots and slide members in the body board are protected from contact with dirt or water from below the body board by waterproof protective covers 93 of polyvinylchloride bonded to the lower surface of the body board 40 and within which the slide members 55 to 60 can move along their respective slots.

It will be appreciated from study of FIG. 6 that if the mattress 11 is deflated, the stiffener strings 64 and 85 can take up the relaxed disposition, flat above the board 40 and overlying an edge of the deflated mattress 11, and that as the mattress 11 is inflated the strings will be pushed into the standing disposition shown in FIGS. 5 and 6.

In fact, inflation of the stretcher from the compact disposition of FIG. 4 to the flat disposition of FIGS. 1 and 5 can be automatic, the inflation of the mattress 11 first urging the body board 40 to open out flat and then urging the stiffener strings to assume their standing disposition in which, it will be appreciated, they are each sandwiched between one of the flank tubes 12 and 13 and the mattress 11. This sandwiching helps to keep the stiffener strings 64 and 85 properly upright, and ensures that the fabric hinges 61 are not required to withstand an unbalanced pressure from the inflated mattress 11 during use of the stretcher, thereby protecting the fabric hinges 61 to 63 against undue tension and wear.

Figure 7:
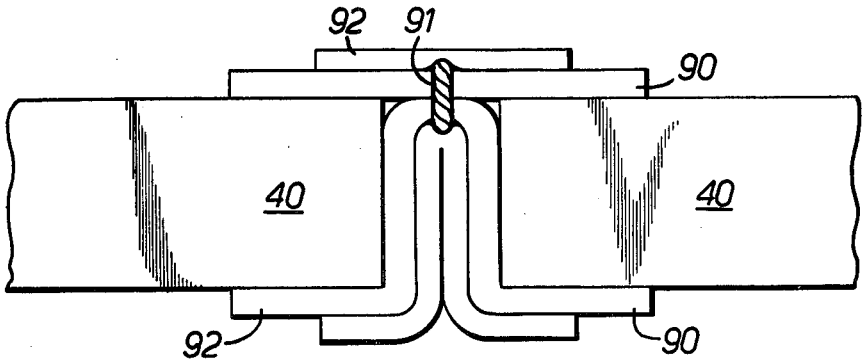
FIG. 7 is an enlarged detail of FIG. 4 showing the construction of one of the fabric hinges connecting two adjacent portions of the body board of the stretcher.

FIG. 7 shows one of the fabric hinges 48 when fully open. Each hinge has two fabric hinge members 90 each bonded to two adjacent portions of the body board 40 and connected to one another by a centre stitch 91. Short lengths of fabric holding tape 92 cover the area of the hinge and, in particular, the exposed surface of the centre stitch 91.

We claim:

1. A stretcher characterised in that it comprises:

(a) means for providing a rigid surface large enough to provide support to a supine human body over substantially the entire width and length of the body, comprising:

(i) a body board made up from at least three rigid, body support board portions which extend in a transverse direction across the full width of the body board and in a longitudinal direction along a portion of the length of the board, (ii) a hinge member disposed between each support board portions and the adjacent portion or portions along the length of the board, and (iii) stiffening means for resisting downward movement of the board or each portion of the board, when the stretcher is in use and supported at its ends above the ground, said hinge member and said stiffening means limiting the movement of the board portions relative to one another to movement between a compact, transport disposition of the stretcher and flat, useful disposition of the stretcher; and, (b) an inflatable body cushioning means which is situated between the rigid surface and the supine human body in use of the stretcher.

2. A stretcher as claimed in claim 1 characterised in that the board portions are circumadjacent the body cushioning means when the stretcher is in said compact transport disposition thereby affording some protection to the cushioning means.

3. A stretcher as claimed in claim 1 characterised in that the body cushioning means comprises a trunk cushion and a head cushion, and in that means are provided for establishing a chosen degree of inflation of the head cushion different from that of the trunk cushion.

4. A stretcher characterised in that it comprises: a body board made up from at least three rigid body support board portions which extend in a transverse direction across the full width of the body board and in a longitudinal direction along a portion of the length of the board, and means for limiting movement of the board portions relative to one another to movement between a compact transport disposition of the stretcher and a flat useful disposition of the stretcher, said movement limiting means comprising a hinge member disposed between each support board portions and the adjacent portion or portions along the length of the board and stiffening means for resisting downward movement of the board or each portion of the board, when the stretcher is in use and supported at its ends above the ground.

5. A stretcher as claimed in claim 4 characterised in that, in the compact transport disposition, the stretcher takes the form of a pack to be carried on the back of a single human bearer.

6. A stretcher as claimed in claim 1 or 4 characterised in that the stiffening means comprises a pair of stiffening strings, each of which strings is located along an opposed longitudinal edge of the body board when the stretcher is in said useful disposition.

7. A stretcher as claimed in claim 1 or 4 characterised in that the stiffening means comprises a pair of stiffening strings, each of which strings is located along an opposed longitudinal edge of the body board when the stretcher is in said useful disposition, and further characterised in that each of the stiffening strings comprises a line of rigid string elements, each of which elements is connected to one of the board portions for movement of the element relative to the portion between a standing disposition and a relaxed disposition, the said string elements being hingedly connected to one another with the pivotal axis of the hinges lying perpendicular to the plane of the body board when the string elements are in said standing disposition, and in a plane lying parallel to the plane of the body board when the string elements are in said relaxed disposition, whereby the strings provide a stiffening function only when they are in said standing disposition, and permit movement of the body board portions from the useful disposition to the transport disposition only when they are in said relaxed disposition.

8. A stretcher as claimed in claim 7 characterised in that the strings are disposed along the longitudinal edges of the cushioning means, and on an upper face of the body board, and overlie the deflated cushioning means in the relaxed disposition, so that inflation of the cushioning means urges the strings to move from the relaxed disposition to the standing disposition.

9. A stretcher as claimed in claim 7 characterised in that each of the strings is held in the standing disposition sandwiched between the cushioning means and an inflatable flank tube mounted on one longitudinal edge of the body board.

10. A stretcher as claimed in claim 1 or 4 characterised in that it includes inflatable flank tubes, mounted one on each longitudinal edge of the body board.

11. A stretcher as claimed in claim 10 characterised in that the flank tubes are buoyancy tubes.

12. A stretcher as claimed in claim 10 characterised in that each of the flank tubes has an abrasion-resistant downward facing surface faired at one end at least of the stretcher to facilitate sledging thereof.

13. A stretcher as claimed in claim 12 characterised in that the flank tubes are nipped in at a waist area, thereby to restrict the overall width of the inflated stretcher.

* * * * *